United States Patent [19]

Asari et al.

[11] 4,441,353

[45] Apr. 10, 1984

[54] CLAMP MECHANISM FOR UPSETTER

[75] Inventors: Akira Asari, Osaka; Takashige Yamamura, Kobe; Tsuneya Veno, Takasago, all of Japan

[73] Assignee: Kabushiki Kaisha Kobe Seiko Sho, Kobe, Japan

[21] Appl. No.: 343,218

[22] Filed: Jan. 27, 1982

[30] Foreign Application Priority Data

Jan. 29, 1981 [JP] Japan ..... 56-13495

[51] Int. Cl.[3] ..... B21D 7/06

[52] U.S. Cl. ..... 72/316; 72/357; 72/452; 72/478; 72/416

[58] Field of Search ..... 72/305–307, 72/316, 317, 357, 358, 352, 353, 404, 444, 452, 478, 477, 415, 416

[56] References Cited

U.S. PATENT DOCUMENTS

| | | | |
|---|---|---|---|
| 880,567 | 3/1908 | Palmer | 72/316 |
| 1,633,970 | 6/1927 | Ball | 72/357 |
| 2,341,602 | 2/1944 | Dewey | 72/316 |
| 2,796,109 | 6/1957 | Wood | 72/478 |
| 3,474,657 | 10/1969 | Spiegel | 72/478 |
| 3,991,681 | 11/1976 | Antosiak | 72/452 |

FOREIGN PATENT DOCUMENTS

| | | | |
|---|---|---|---|
| 947037 | 8/1956 | Fed. Rep. of Germany | 72/416 |
| 2111988 | 11/1971 | Fed. Rep. of Germany | 72/452 |
| 8200 | of 1900 | United Kingdom | 72/452 |

*Primary Examiner*—Daniel C. Crane

*Attorney, Agent, or Firm*—Oblon, Fisher, Spivak, McClelland & Maier

[57] ABSTRACT

A clamp mechanism for upsetter having a row of N-number of split dies each having an upset die and a clamp die, a grip mechanism for opening and closing said dies by relative movement toward and away from each other, and an upset mechanism including punches retractably protrudable into the dies, the clamp mechanism including N-number of pressurizing cylinders opposingly positioned with respect to the respective dies, link members for transmitting the power of the pressurizing cylinders separately to clamp dies of the respective dies, and (N−1)-number of coupling members provided in association with the link members for interlocking the latter to transmit the combined power of the N-number of pressurizing cylinder to (N−1)-number of clamp dies when increased power is required.

5 Claims, 16 Drawing Figures

PRIOR ART

CLAMP MECHANISM FOR UPSETTER

BACKGROUND OF THE INVENTION

1. Field of the Invention

This invention relates to an upsetter for upsetting end portions of elongated work member of steel and like materials, and more particular to a clamp mechanism for an upsetter which is capable of clamping work members securely to prevent sliding deviations of work members in dies when an upsetting force is applied or when associated punches are withdrawn after upsetting operation, gripping individual works separately in a simultaneous upsetting operation of a plurality of work members no matter whether the work members contain variations in outside diameter (e.g., owing to a large tolerance).

2. Description of the Prior Art

Known upsetters for upsetting ends of lengthy work members are largely classified as a vertical type which has vertically split dies as illustrated in FIGS. 1 and 2 and a horizontal type which has horizontally split dies as illustrated in FIG. 3.

As seen in FIGS. 1 and 2, the vertical type upsetter is provided with vertically split dies 1 and 2 which are opened and closed in a horizontal direction by a drive mechanism which is provided at one side of the machine. The upsetter is provided with a U-shaped frame 3 which is open on the upper side and supports on its inner side the above-mentioned dies 1 and 2. In order to prevent the frame 3 from being expanded on the upper open side at the time of gripping work members 4, a cross tie rod 5 is provided perpendicularly along the upper side of the frame 3. Therefore, in the vertical type upsetter with the dies 1 and 2 enclosed on four sides as seen in the direction of arrow II of FIG. 2, there invariably arises the necessity for transferring the work members 4 along a relatively long path of travel to deliver the same to the front side of the machine and for moving the work in the longitudinal directions when inserting and extracting it before and after the upsetting operation.

More specifically, as seen in FIGS. 1 and 2, a work member 4 which has its end portion heated in a furnace 6 is transferred horizontally over a certain distance for delivery to the working position of the upsetter as indicated by arrow I and then moved in the longitudinal direction for insertion into the upsetter as indicated by arrow II. The work member 4 which is inserted in the upsetter is then lowered stepwise as indicated by arrow III to undergo the primary and secondary upsetting operations in the dies 1 and 2. Upon completion of the upsetting operation, the work member 4 is drawn out of the upsetter by moving the same longitudinally backward over a substantial distance as indicated by arrow IV and then lifted to the initial level as indicated by arrow V, followed by a horizontal movement over a large distance as indicated by arrow VI for transfer to the location of the next operation.

Consequently, the forming operation by a vertical upsetter entails the transfer of the heated or upset work member 4 in horizontal directions as indicated by arrows I and VI within a short time period in addition to large longitudinal movements in the directions of arrows II and V. Namely, it entails the drawback that it requires complicated and costly transfer and handling mechanisms for moving the work member in lateral, longitudinal and vertical directions. Besides, there has to be provided a long path of transfer in total to cope with the large breadth of the upsetter including the drive mechanism provided at one side thereof, and the transfer of works in three different directions, resulting in a prolonged time for one cycle of operation, lower productivity and high production cost.

Especially, in the case of hot forging, the work members cool off while moved along the long path of transfer, so that greater force and energy are required for the upsetting operation and the number of consecutive operations which are possible per one heating is limited. Consequently, due to the difficulty of completing the forming operation with only one heating stage, there arise the necessities for die replacement and reheating of the works before finishing the upsetting operation.

In order to eliminate these drawbacks, there has been developed a horizontal type upsetter which, as seen in FIG. 3, is provided with horizontally split dies 8 and 9 in a horizontal row. The dies 8 and 9 and opened and closed vertically by a drive mechanism which is located over the dies 8 and 9.

As shown in FIG. 3, in the horizontal type upsetter, work members which are passed horizontally through part of the split dies 8 and 9 are moved back and forth to avoid the interference of paired pull rods 11 which serve to maintain the gripping force of the dies 8 and 9. That is, the work members which are fed into the machine in a slightly retracted position to dodge the pull rod 11 are pushed in and they are fed transversely to undergo sequentially the primary and secondary upsetting operations in the dies 8 and 9, respectively. Upon finishing the upsetting, the work members are retracted again to avoid interference of the other pull rod 11 before they are discharged from the upsetter for transfer to the location of the next operation.

The horizontal type upsetting machine which has a smaller width needs a shorter path of travel and thus contributes to shortening the cycle time of the upsetting operation and enhances the productivity as compared with the vertical type. Another advantage of the horizontal type upsetter resides in the fact that the transfer and handling mechanisms can be simplified to a significant degree as the main transfer routes are all in the same horizontal plane. Further, in contrast to the vertical type the dies of which are enclosed by a frame on four sides, the horizontal type upsetter permits observation of the conditions of upset products from three sides when the dies are opened and accordingly it has an advantage that some suitable measures can be taken promptly to remove the cause of a defect as soon as a defective product comes out.

Although the path of travel of work members in the horizontal upsetter is two-dimensional, that is to say, on one horizontal plane, the work members have to be moved in the longitudinal directions to evade collision with the pull rods 11 which move only a small distance in the longitudinal direction. Namely, there still remains the problem of complicated transfer or feed mechanism in the known horizontal upsetter which is not constructed to transfer the works or products along a linear path.

Further, the clamp mechanism in either type of the above-described conventional upsetter is usually provided with unitary die holders 14 and 15 on die plates 16 and 17 for holding in juxtaposed position upper and lower clamp dies 12 and 13, respectively, as seen in FIG. 16 which exemplifies a horizontal type upsetter, pressing the upper dies and die holders by a hydraulic cylider 19 which is provided in a tong head 18 integrally with the upper die plate 16. Therefore, in the particular example shown, when a couple of tubes which contain variations in outside diameter are simultaneously clamped, one clamp die which receives a tube of a smaller diameter fails to grip it securely against skidding forces upon the thrust of punches 20 in the upsetting stage, making the simultaneous upsetting of the two tubes impossible.

Such a clamping failure leads to drop in product quality and to difficulty in performing the upsetting operation itself especially in the case of oil well tubes which have a relatively large tolerance in the outside diameter as compared with other steel workpieces and which are formed in a broad range of various outside diameters, for example, in the range of 30 mm to 270 mm. In addition, the clamp mechanism of the conventional upsetter employs a hydraulic cylinder 19 of a predetermined capacity so that it has been difficult to increase the clamping force and thus to change the clamping power of the upsetter to a higher required level.

SUMMARY OF THE INVENTION

It is therefore an object of the present invention to provide an upsetter employing a clamp mechanism which overcomes the above-mentioned drawbacks and problems, particularly the failure in clamping simultaneously a number of work members.

More specifically, the present invention has as its object the provision of a clamp mechanism for an upsetter, which is capable of clamping works securely and rigidly no matter whether the works have variations in outside diameter, and which can produce an increased clamping force in a simple and easy manner when a higher clamping force is required.

It is another object of the present invention to provide a clamp mechanism for an upsetter, which can produce a clamping force sufficient for holding tubes against sliding deviations caused by an upsetting force in the forging stage or by a punch withdrawing force subsequent to the forging stage when upsetting end portions of tubes by means of an adjustable hydraulic cushioning mechanism acting through a roller wedge mechanism, clamping the tubes stably with an optimum force according to the tube size and irrespective of variations in the outside diameter of the tubes.

It is still another object of the present invention to provide a clamp mechanism employing a slide block with a cylindrical surface between clamp dies and wedge mechanism, to thereby permit the clamp dies to clamp work members stably in parallel relation with the latter.

According to the present invention, there is provided a clamp mechanism for an upsetter having a row of an N-number of split dies each having an upset die and a clamp die, a grip mechanism for opening and closing the dies by relative movement toward and away from each other, and an upset mechanism including punches retractably protrudable into the dies, the clamp mechanism including a number (N) of pressurizing cylinders opposingly provided to the respective dies; an operating link mechanism having a number of link members for transmitting the power of the pressurizing cylinders separately to clamp dies of the respective dies; and (N−1) sets of coupling members for interlocking the operating link members to transmit combined power of the N-number of pressurizing cylinders to up to N clamp dies.

The above and other objects, features and attendant advantages of the present invention will become apparent from the following description and the appended claims, taken in conjunction with the accompanying drawings which show by way of example preferred embodiments of the invention.

DETAILED DESCRIPTION OF THE PREFERRED EMBODIMENTS

Figure 1:
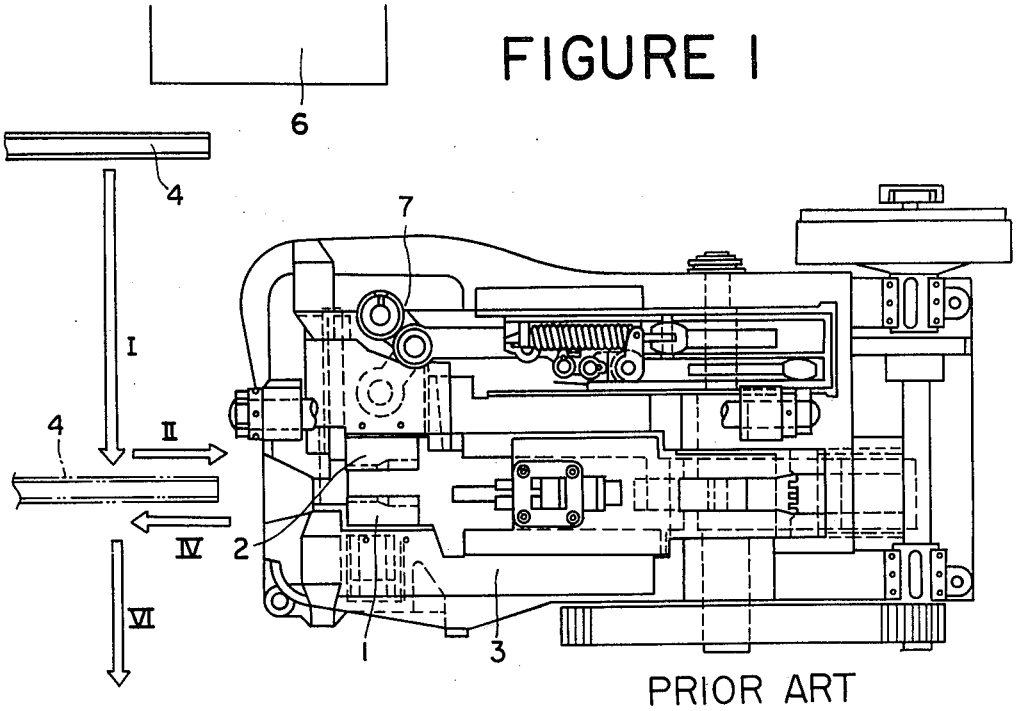
FIG. 1 is a plan view of a conventional vertical type upsetter.
Figure 2:
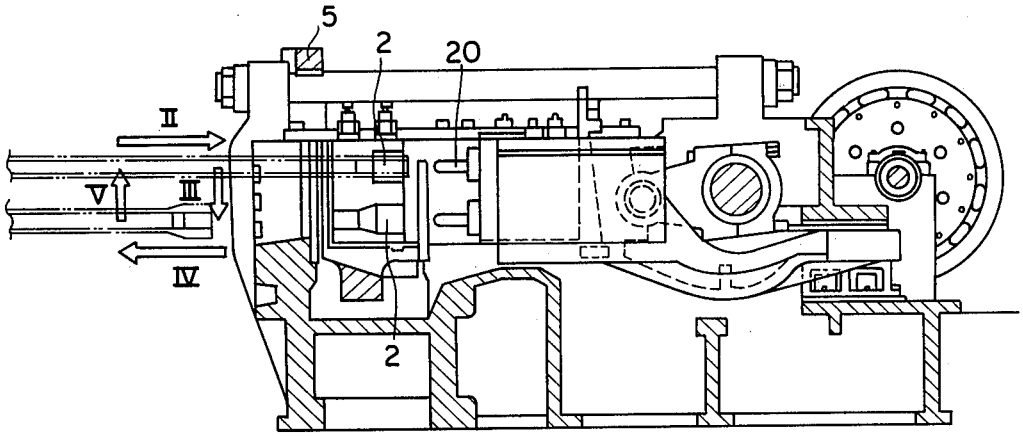
PRIOR ART FIGURE 2
FIG. 2 is a sectioned side elevational view of the same upsetter.
Figure 3:
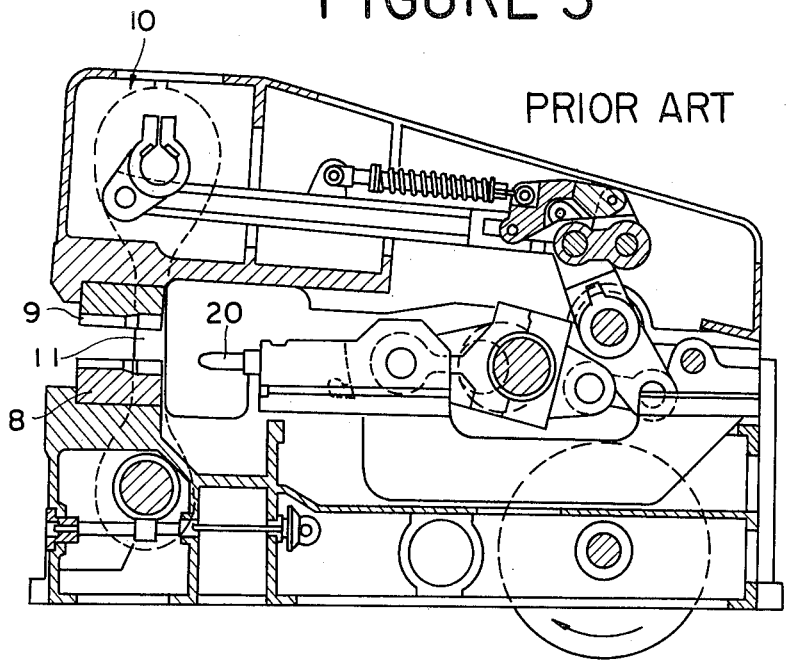
FIG. 3 is a sectioned side elevational view of a conventional horizontal type upsetter.
Figure 4:
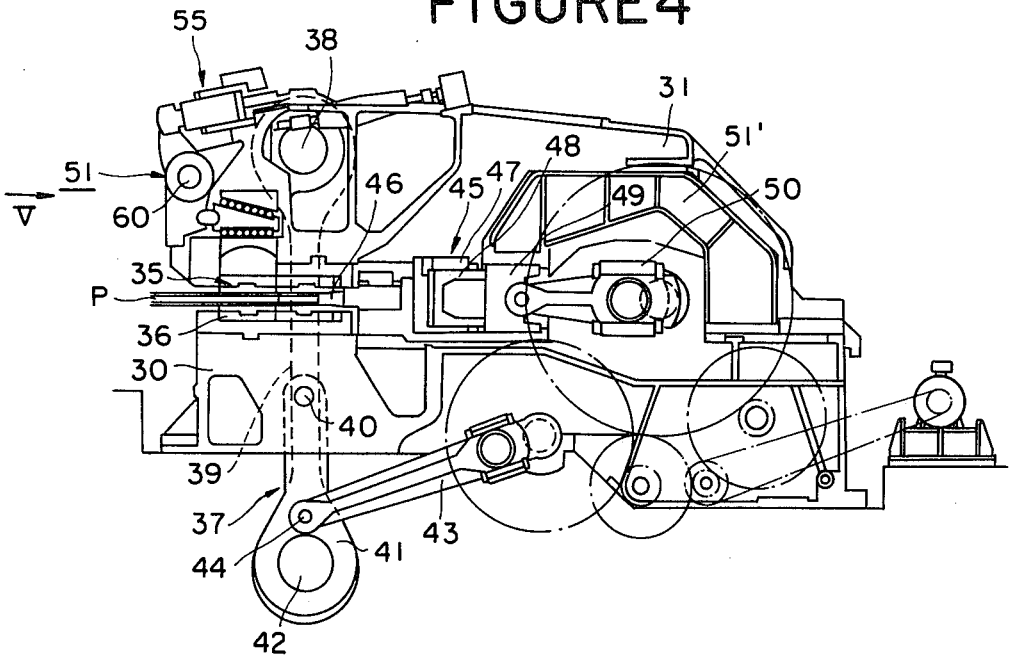
FIG. 4 is a diagrammatic side elevational view of an upsetter according to the present invention.

Reference is now made to FIG. 4 and the remaining FIGURES which illustrate preferred embodiments of the invention and of which FIGS. 4 to 15 depict upsetters which also overcome the above-mentioned drawbacks of the conventional vertical and horizontal upsetters. Particularly, the embodiment of FIG. 4 is provided with a mechanism, more specifically, with an upset slide cushioning mechanism which absorbs volumetric variations of works for preventing underfil or side burrs attributable to a large weight tolerance of works like oil well tubes which have a relatively large tolerance in both outside diameter and wall thickness.

Firstly, the general construction of the upsetter is explained with reference to FIG. 4 before going into the details of the clamp mechanism itself of the invention.

Figure 13:
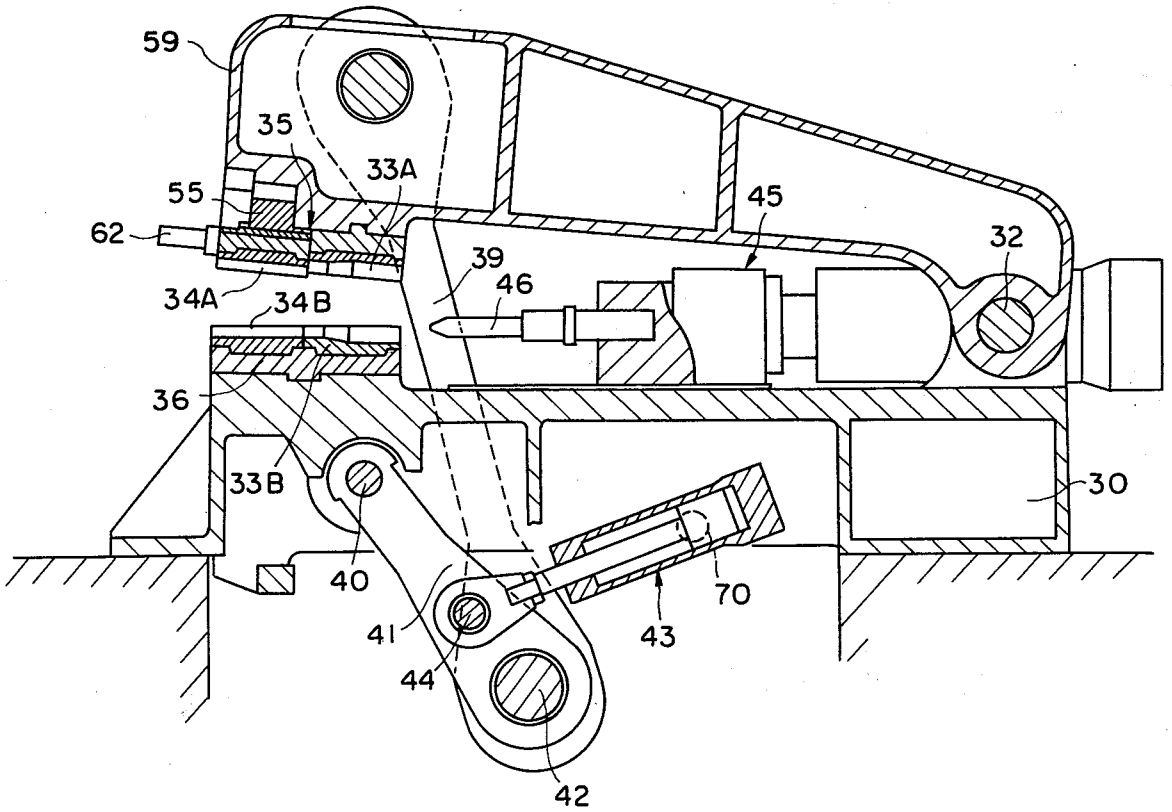
FIG. 13 is a sectioned side elevational view of a third embodiment of the present invention in a die opening stage.
Figure 14:
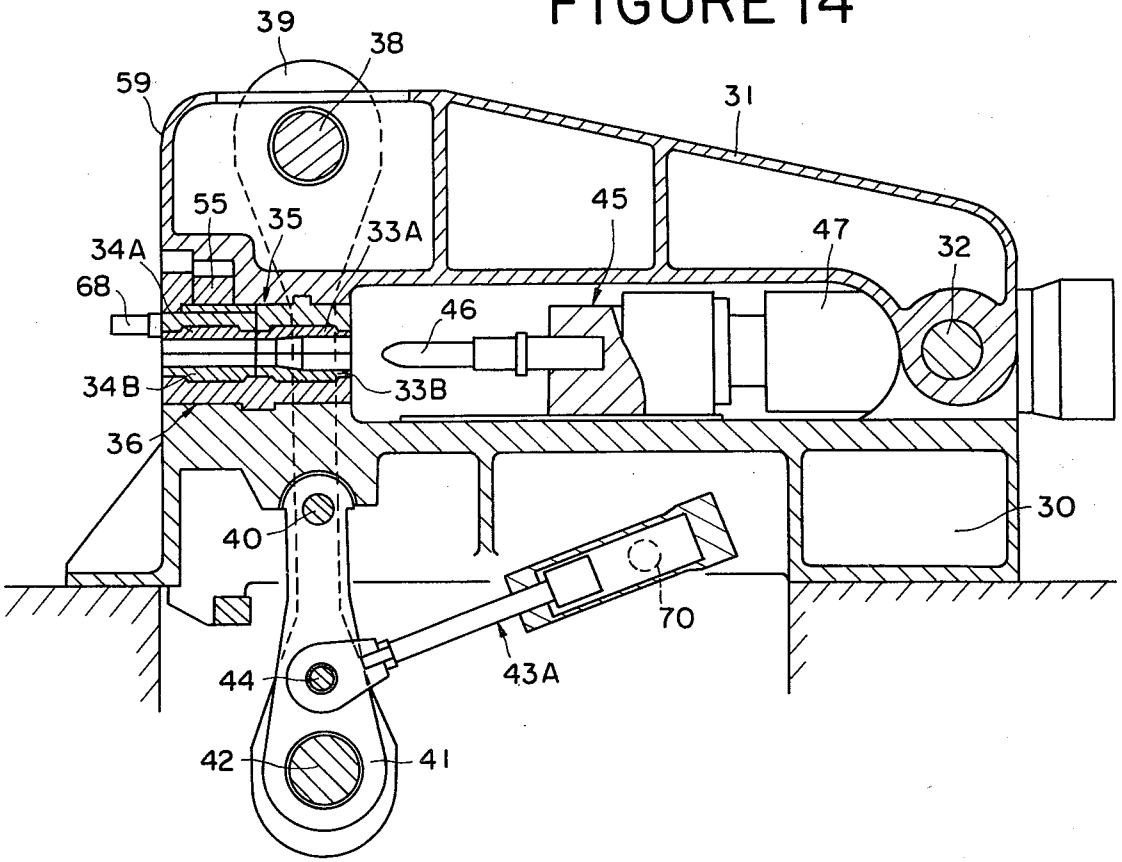
FIG. 14 is a sectioned side elevational view of the same upsetter in a die closing stage.
Figure 16:
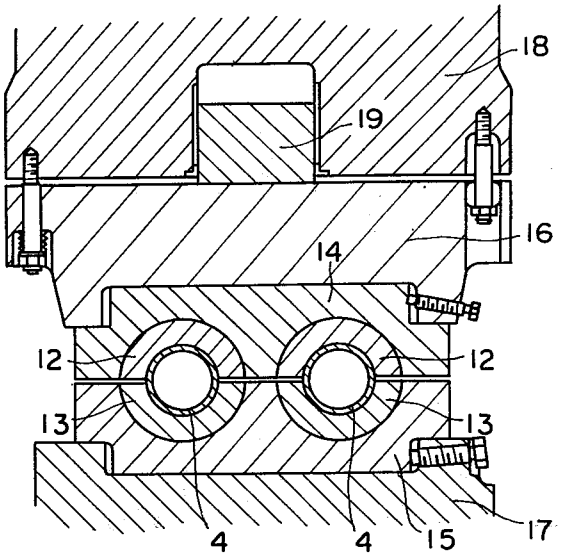
FIG. 16 is a view similar to FIG. 15 but showing a conventional counterpart.

Referring to FIG. 4, the upsetter is provided with a bed 30 and a gripping tong 31 which are pivotally connected at one end of each thereof through a shaft 32 shown in FIG. 13. Provided transversely across the opposing free ends of the bed 30 and tong 31 are a row of split dies having upset die sections 33A, 33B and clamp die sections 34A, 34B as shown in FIGS. 13 and 14.

The bed 30 and tong 31 are opened and closed by relative movement toward or away from each other through operation of a grip drive mechanism 37 which, in the particular embodiment shown, includes a pair of pull rods 39 pivotally supported on the tong head by a shaft 38, a pair of grip links 41 having one end thereof of each pivotally supported on the bed 30 through a shaft 40 and the other ends pivotally supported by shaft 42 along with the pull rods 39, and a grip drive 43 pivotally supported by a shaft 44 between the links 41.

Indicated by reference number 45 is an upset mechanism which includes punches 46, a cylinder tube 47 detachably mounting thereon the punches 46, a piston 48 slidably fitted in the tube 47, a cross-head 49, and a drive unit 50, which are provided on a slide 51' for retractably protruding the punches 46 into the dies 35 and 36. A relief mechanism, namely, a hydraulic cushioning mechanism which absorbs volumetric variations of works is provided between the drive unit 50 and upset slide 51'.

Reference number 51 denotes a clamp mechanism according to the present invention, which, in the particular embodiment shown, has the movable clamp dies 34A each mounted on a slide block 52 through a die holder, and linked to hydraulic cylinders 55 with a hydraulic cushioning function through a wedge block 53 and an actuator in the form of a clamp lever 54.

Referring to FIGS. 5 to 8, a plurality of transversely aligned movable dies 34A, two in the particular embodiment shown, are mounted on die plates 56 which are provided with a spherical seat 56A on the upper side thereof for fitting engagement with a cylindrical surface on the underside of slide blocks 52. Each wedge block 53 which has a wedge-like circumference 53A in the axial direction of the upset punch is fitted between the slide block 52 and an upper wedge plate 57 through bearings 58 like rollers or bushes for sliding movements in the axial direction of the punch.

On the other hand, a clamp lever actuator 54 is oppositely mounted on the tong head 59 to each wedge block 53, the clamp lever actuator 54 having its middle portion pivotally supported on a shaft 60 which extends perpendicularly to the axis of the upset punch. One end of each actuator 54 is operatively linked to the piston 55A of the hydraulic cylinder 55 which has its cylinder tube 55B fixedly mounted on the tong head 59.

Provided at the other end of each clamp lever 54 is a push rod 61 which is operatively connected to the each wedge block 53 through a spherical joint. Therefore, the power of N-number of cylinders 55 is transmitted to the wedge blocks 53 in the direction of arrow A through the push rods 61 as shown particularly in FIG. 6, separately operating the clamp dies 34A as indicated by arrows B in FIG. 5. Namely, the clamp dies 34A are separately driven by the sliding movements of the wedge blocks 53 in the direction of arrow A in FIG. 6 to clamp firmly the respective blank pipes (not shown).

Designated by reference number 62 are coupling members, which in the particular embodiment shown, include a pair of hydraulic cylinders with the respective cylinder tubes 62A mounted on the upper and lower portions of one actuator lever 54. The piston rods which are fitted in the cylinder tubes 62A are provided with coupling blocks 62B at the respective fore ends, which are disengageably engaged with opposing upper and lower ends of the clamp levers 54 for interlocking the same.

Figure 6:
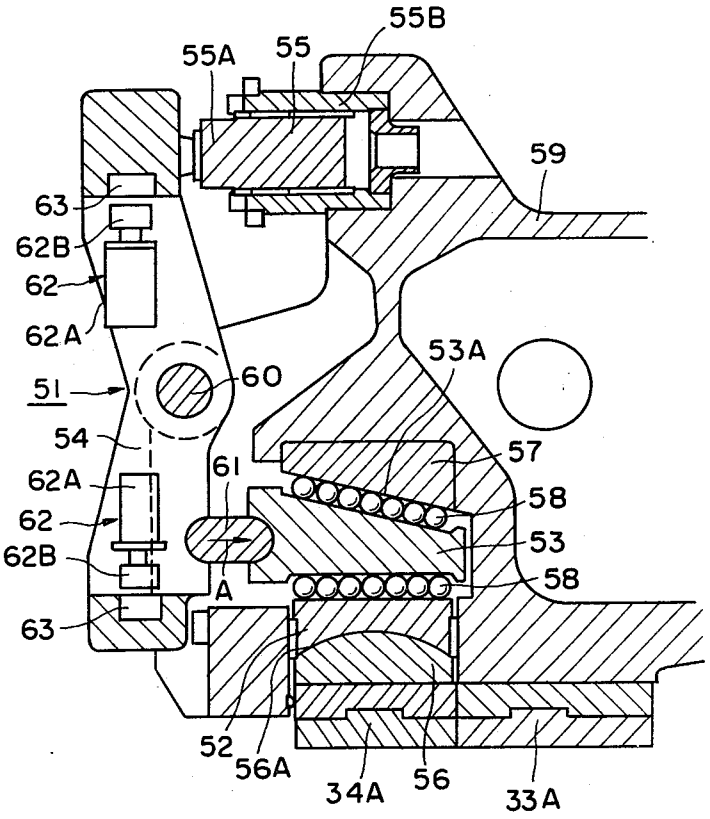
FIG. 6 is a sectioned side elevational view of the clamp mechanism of FIG. 4.
Figure 5:
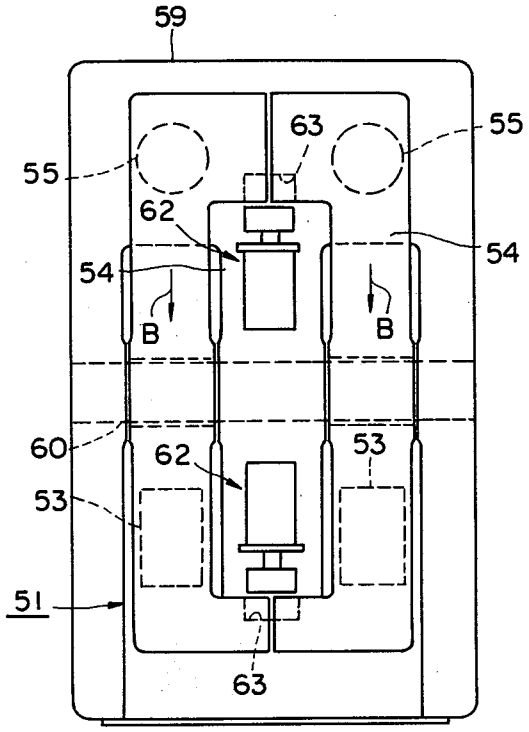
FIG. 5 is a front view of the operating links as taken in the direction of arrow V of FIG. 4.
Figure 8:
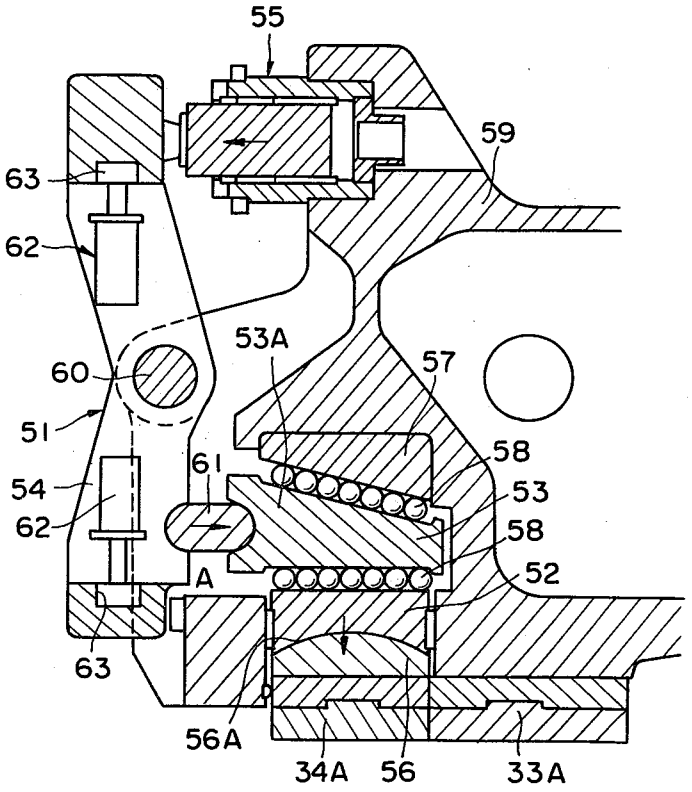
FIG. 8 is a sectioned side elevational view of the clamp mechanism of FIG. 4, in a stage of engaging a coupler member.
Figure 7:
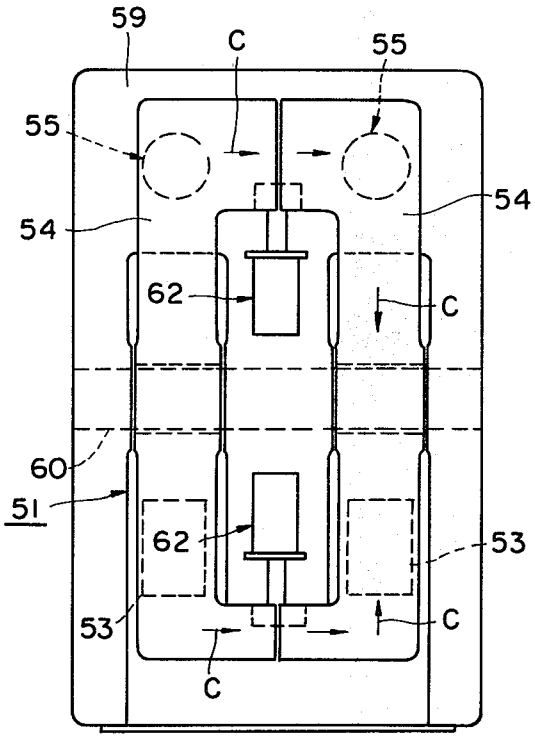
FIG. 7 is a view similar to FIG. 5 but showing the operating links in a stage of engaging a coupler member.
Figure 10:
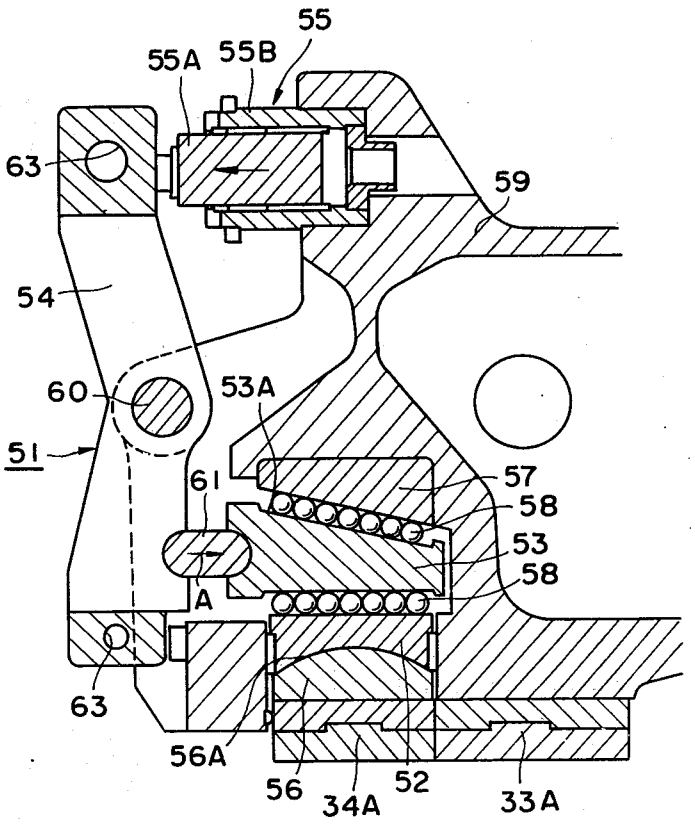
FIG. 10 is a sectioned side elevational view of the clamp mechanism of the second embodiment of the invention.
Figure 9:
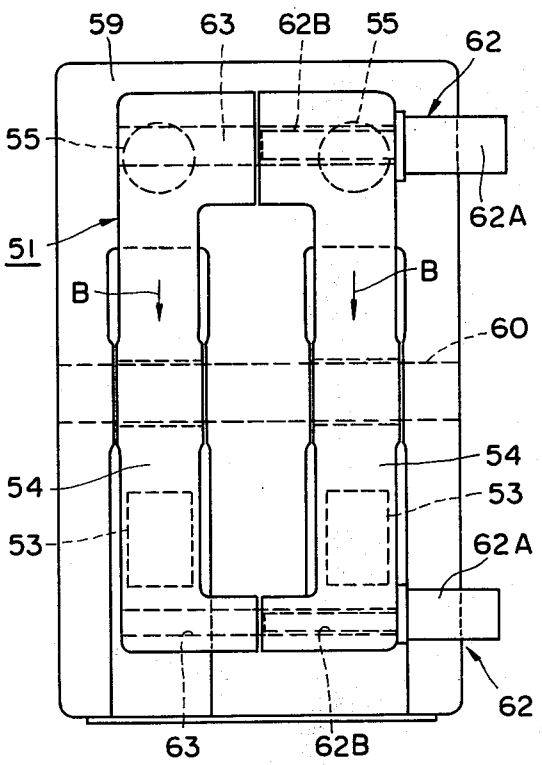
FIG. 9 is a view similar to FIG. 5 but showing a second embodiment of the invention.
Figure 12:
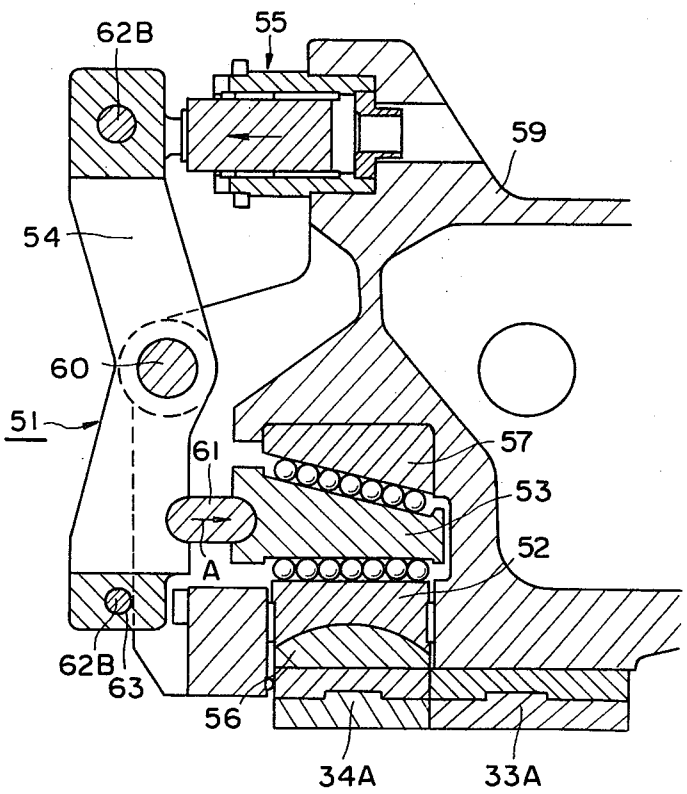
FIG. 12 is a sectioned side elevational view of the clamp mechanism of the second embodiment.
Figure 11:
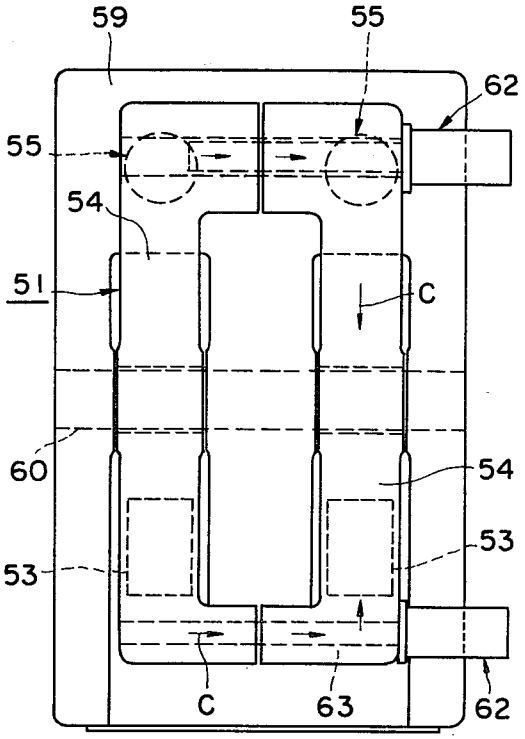
FIG. 11 is a view similar to FIG. 7 but showing the second embodiment.

Namely, when the coupling members 62 are in a disengaged state, that is to say, in the position shown in FIGS. 5 and 6, the forces of the hydraulic cylinders 55 are transmitted separately through the respective clamp dies 34A as indicated by arrows B, magnifying the clamping forces by the wedge actions of the wedge blocks 53. If the piston-cylinders of the upper and lower coupling members are extended to engage the coupling blocks 62B in the locking recesses 63, the opposing clamp levers 54 are interlocked integrally with each other to apply the power of the two up to N number of hydraulic cylinders 55 to up to N clamp dies, to a sole clamp die 34A in the particular embodiment shown as indicated by arrow C, permitting increasing of the clamping force whenever a higher power is required.

Referring now to FIGS. 9 to 12, there is shown a second embodiment of the present invention, which is same as the preceding embodiment shown in FIGS. 5 to 8 except that the coupling members 62 are adapted to disengageably engage in bores formed in the upper and lower end portions of the clamp levers 54. Although the coupling members 62 are provided on one clamp lever in the second embodiment, it is preferable to provide them on the respective clamp levers from the standpoint of weight balance.

Figure 15:
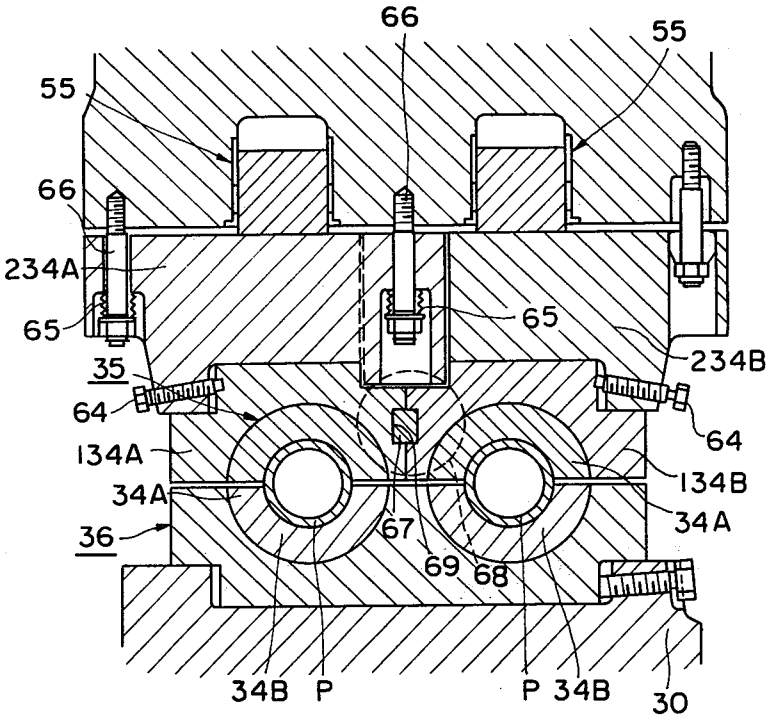
FIG. 15 is a sectional view of a clamp mechanism, of the third embodiment.

FIGS. 13 to 15 illustrate a third embodiment of the invention, in which a plurality (N) of hydraulic cylinders 55 are formed side-by-side in the tong head 59 and the upper clamp dies 34A are provided in split die holders 134A and 134B which are in turn supported on split suspension blocks 234A and 234B through positioning bolts 64. Each one of the suspension blocks 234A and 234B is suspended from the tong head by suspending bolts 66 through restorable resilient members 65 for vertical movement along the shanks of the suspending bolts 66. The hydraulic cylinders 55 are provided separately for the respective suspension blocks 234A and 234B.

Thus, a plural number (N) of dies, a couple of dies 35 and 36 with upset dies 33A and 33B and clamp dies 34A and 34B in the third embodiment, are also provided successively in a row extending transversely of the upsetter, clamping separately blank tubes P with clamp dies 34A and 34B securely even if they have different outside diameters.

Further, provided on the part of the tong head is a coupling member which in this embodiment, is constituted by a hydraulic cylinder 68 with a cotter 67. When the hydraulic cylinder 68 is extended, the cotter 67 is inserted in locking grooves 69 which are formed in the adjoining surfaces of the split die holders 134A and 134B, particularly as shown in FIG. 15. Therefore, in this embodiment, it is also possible to clamp a blank tube P firmly in either the die 35 or 36 with an increased force by applying the combined force of the two hydraulic cylinders 55.

In other respects, the third embodiment is substantially the same as the first embodiment of FIG. 4 except for the use of a telescopic hydraulic cylinder 43 as a drive source in place of the grip drive mechanism 37 of FIG. 4. The hydraulic cylinder 43 is pivotally supported on the bed 30 through a shaft 70. Other like component parts are designated by like reference numerals.

The clamp mechanism of the present invention operates as follows. In an operation for upsetting tube ends, the clamp mechanism is required to prevent sliding deviations of blank tubes P by the upsetting force applied by the upset mechanism in the forging stage and by the punch drawing force in a stage immediately after the forging operation, and at the same time to be able to clamp firmly blank tubes P irrespective of a broad tolerance or variations in outside diameter even in an upsetting operation working simultaneously a plurality of blank tubes, since failure to satisfy these requirements will lead to undesirable deformations or a drop in the quality of the products.

Therefore, in the first and second embodiments of the invention, the upsetter employs a wedge mechanism or a hydraulic cushioning mechanism which is adapted to transmit output power of a hydraulic cylinder through a wedge block.

As blank tubes P are fed to predetermined positions in dies 35 and 36 and the tong 31 is lowered to the lower dead center, the dies 35 and 36 are closed by a predetermined gripping force. Although the upper clamp dies 34A begin to clamp the tubes P immediately before the lower dead center position, the power of the hydraulic cylinders are imposed on the clamp dies through the roller wedge mechanism including the wedge blocks 54 which has a cushioning effect according to variations in outside diameter of the tubes P. Consequently, the tubes P are invariably gripped with a stable and constant gripping force even when the tubes contain variations in outside diameter. Besides, the roller wedge mechanism in the first and second embodiments is provided over the clamp dies 34A and 34B and arranged to receive the clamping force over a broad area, so that it can smoothly slide in its cushioning action to stably guarantee the required clamping force. The cylindrical surface of the slide block which is provided between the roller wedge mechanism and a clamp die 34A serves to maintain the upper and lower clamp dies 34A and 34B parallel with the tube P so that the latter is stably clamped in the dies with a uniform gripping force.

Further, in the first and second embodiments, as the power of a plurality (N) of hydraulic cylinders 55 is transmitted to the respective clamp dies 34A separately through a link mechanism using a clamp lever 54, the power of the gripping cylinder can be minimized depending upon the link ratio.

In the above-described first to third embodiments, the hydraulic cylinders 55 are provided correspondingly to the N-number of clamp dies (two in the particular embodiments shown) which are located side by side on the machine to clamp an N-number of blank tubes P separately and securely no matter whether the clamped tubes contain variations in outside diameter or are of different outside diameters. In addition to the improvement of productivity, this clamp mechanism prevents localization of load when a plurality (N) of tubes P are simultaneously upset by an upset mechanism including the punches 46, and thus contributes to improving the quality of products and prolonging the life of bearing portions of the machine.

Further, in the first to third embodiments of the invention, the clamping force can be magnified by engaging the coupling members 62, more particularly, by interlocking the two clamp levers 54 in the first and second embodiments or by unifying the split die holders 134A and 134B in the third embodiment, to clamp a single tube P firmly and stably by the combined force of the two hydraulic cylinders 55.

The pull rods 39 of the grip mechanism are swung back when the dies 35 and 36 are opened, as shown in FIG. 13, so that the tubes P or upset products can be transferred linearly across the machine without colliding against the pull rods. Thus, the upsetter with the clamp mechanism of the invention achieves the objects as stated hereinbefore in an effective manner, and is especially suitable for upsetting elongated work members of steel or the like, particularly, for upsetting oil well tubes.

Although the clamp mechanism is provided with a couple of hydraulic cylinders 55 for a couple of clamp dies 34A, it is to be understood that there may be provided more than three hydraulic cylinders 55 opposingly to an N-number of clamp dies for operating the respective clamp dies separately and, if necessary, applying the combined clamping force of the hydraulic cylinders one to up to N clamp dies by engaging (N−1) sets of locking members. The hydraulic cylinder 55 which is employed in the foregoing embodiments for its superiority may be replaced by a pneumatic cylinder or other fluid-pressure cylinder if desired.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An upsetter having a clamp mechanism comprising a row of a plural N-number of split dies where N is an integer greater than 1 and where each split die further comprises an upset die and a clamp die, a grip mechanism for opening and closing said dies by relative movement toward and away from each other, and an upset mechanism including a plurality of punches retractably protrudable into said dies, said clamp mechanism comprising:

a plural N-number of pressurizing cylinders, one cylinder positioned opposingly to each of the respective split dies;

operating link means which further comprise a plurality of like members for transmitting power, each of said like members transmitting the power one of said pressurizing cylinders separately to the clamp die of one of said respective split dies; and (N−1) coupling means for selectively interlocking said operating link members to transmit the combined power of said N-number of pressurizing cylinders to up to N number of said clamp dies, each said coupling means being positioned and constructed for selectively interlocking two adjacent ones of said operating link members.

2. The upsetter as set forth in claim 1, wherein said operating link means further comprises a transverse shaft, a push rod, a plurality of clamp levers each pivotally supported in a middle portion thereof on a transverse shaft and having a first end thereof connected to one of said pressurizing cylinders and a plurality of wedge blocks operatively associated with a second end opposite said first end of said clamp levers through said push rod and wherein each further comprises a wedge portion slidable in an axial direction of the upset die, and each of said (N−1) coupling means further comprises at least one pressurizing cylinder mounted on part of each of said clamp levers and including means for disengageably interlocking said clamp levers.

3. The upsetter as set forth in claim 1, further comprising a plurality of split die holders wherein said pressurizing cylinders are formed in said grip mechanism and each further comprise means to operate said clamp die sections separately through each of said split die holders.

4. The upsetter as set forth in claim 3, wherein said die holders have split surfaces forming locking recesses therein wherein said pressurizing cylinders are formed in said grip mechanism, and each of said coupling members further comprises a fluid cylinder having a cotter retractably engageable in said locking recesses formed in said split surface portions of adjoining die holders.

5. An upsetter having a clamp mechanism comprising a row of a plural N-number of split dies where N is an integer greater than 1, wherein each of said split dies further comprise an upset die and a clamp die, a grip mechanism for opening and closing said dies by relative movement toward and away from each other, and an upset mechanism which further comprises a plurality of punches retractably protrudable into said dies along an axial direction, said clamp mechanism comprising:

a plural N-number of pressurizing cylinders one cylinder provided opposingly to each of the respective split dies;

clamp lever link means for transmitting forces of each of said pressurizing cylinders separately to the clamp die of said respective split dies and which further comprises a plurality of clamp levers having a first end thereof connected to said pressurizing cylinders and at least one wedge block associated with a second end opposite said first end of each of said clamp levers and having a wedge portion slidable in the axial direction of said punches to impose a clamping force on said clamp dies;

(N−1) coupling means provided on said clamp lever link means for interlocking said clamp lever link means to transmit combined power of said pressurizing cylinders to up to N clamp dies when increased power is required, each of said coupling means being positioned and constructed for selectively interlocking two adjacent ones of said clamp lever link means; and a slide block having a cylindrical surface on one side thereof and interposed between each wedge block and an opposing clamp die of said clamp dies.

* * * * *

UNITED STATES PATENT AND TRADEMARK OFFICE

CERTIFICATE OF CORRECTION

PATENT NO. : 4,441,353

DATED : April 10, 1984

INVENTOR(S) : AKIRA ASARI ET AL

It is certified that error appears in the above-identified patent and that said Letters Patent is hereby corrected as shown below:

On the cover, line 2 of inventors, change "Veno to --Ueno--;

In column 1, line 5, change "member" to --members--;

In column 1, line 11, change "operation, gripping" to --operation, and gripping--;

In column 1, line 20, change "horizontally" to --horizontal--;

In column 2, line 8, after "while" insert --being--;

In column 2, line 56, change "evade" to --avoid--;

In column 3, line 2, change "cylider" to --cylinder--;

In column 5, line 11, change "ends" to --end thereof of each--;

In column 5, line 61, between "are" and "coupling" insert --sets of--;

In column 7, line 23, change "are" to --is--;

In column 8, line 45, between "power" and "one" insert --of--.

Signed and Sealed this

Twenty-third Day of April 1985

[SEAL]

*Attest:*

DONALD J. QUIGG

*Attesting Officer* *Acting Commissioner of Patents and Trademarks*